US005431004A

United States Patent [19]

Menegatto

[11] Patent Number: 5,431,004

[45] Date of Patent: Jul. 11, 1995

[54] INSULATING AIR-CONDITIONING AND SOUNDPROOFING APPARATUS FOR TEXTILE MACHINES

[76] Inventor: Carlo Menegatto, Via Spreafico N° 3, 20052 Monza, Milano, Italy

[21] Appl. No.: 90,698

[22] Filed: Jul. 13, 1993

[30] Foreign Application Priority Data

Jul. 24, 1992 [IT] Italy ..... MI92A1811

[51] Int. Cl.[6] ..... D01H 13/28; D01H 13/30

[52] U.S. Cl. ..... 57/308; 57/1 R; 57/304; 62/176.1

[58] Field of Search ..... 57/308, 1 R, 304; 62/176.1, 176.6; 236/44 C, 44 A

[56] References Cited

U.S. PATENT DOCUMENTS

| | | | |
|---|---|---|---|
| 3,073,106 | 1/1963 | Tsuzuki | 57/308 |
| 3,378,998 | 4/1968 | Shackelford | 57/308 X |
| 3,391,528 | 7/1968 | Shackelford | 57/308 X |
| 3,412,545 | 11/1968 | Lippuner | 57/304 |
| 3,641,757 | 2/1972 | Rehn | 57/1 R X |
| 3,782,087 | 1/1974 | Franzen et al. | 57/1 R |
| 3,857,228 | 12/1974 | Nakahara et al. | 57/304 |
| 3,977,169 | 8/1976 | Suzuki et al. | 57/1 R |
| 4,055,937 | 11/1977 | Latus et al. | 57/304 X |
| 4,707,910 | 8/1978 | Furstenberg et al. | 57/304 X |
| 4,773,208 | 9/1988 | Wolf | 57/304 X |
| 5,154,045 | 10/1992 | Saruwatari et al. | 57/304 |
| 5,170,615 | 12/1992 | Strahlen et al. | 57/1 R |

*Primary Examiner*—Daniel P. Stodola
*Assistant Examiner*—William Stryjewski
*Attorney, Agent, or Firm*—Young & Thompson

[57] ABSTRACT

Apparatus for insulating air-conditioning and soundproofing a work area of a textile machine includes a tubular cover arranged around the work area fitted with hatches for inspecting this area, an air-conditioning unit; which takes atmospheric air from the working environment of the machine and, after having conditioned it in a desired manner, feeds it inside the aforementioned tubular cover, and a manifold device for discharging "exhausted" conditioned air, coming from the inside of the tubular cover towards the outside of the working environment of the textile machine itself.

6 Claims, 2 Drawing Sheets

INSULATING AIR-CONDITIONING AND SOUNDPROOFING APPARATUS FOR TEXTILE MACHINES

BACKGROUND OF THE INVENTION

1. Filed of the Invention

The present invention relates to an apparatus for insulating, thermally conditioning and Soundproofing a work area of textile machines, more particularly it aims at insulating, soundproofing and air-conditioning the spindle work area of a winding machine.

2. Description of the Related Art

In winding machines the covering yarn is wound onto the core yarn by means of spindles rotating at considerable speed, driven by means of tangential belts or individual electric motors.

During their motion the spindles, a few hundreds of which can be fitted on a winding machine, generate an unpleasant and excessively high level of noise, a considerable increase in the temperature of the working environment as well as a sharp decrease in the relative humidity of the air in the working environment itself.

The unhealthiness of the working environment in which the winding machines operate forces firms to install special and costly air-conditioning systems in working departments.

Additionally, it should be noted that the vorticose air motions produced by the moving parts of the machine circulate dust which is deposited on the yarns and makes them undesirably dirty.

An apparatus is known which aims at avoiding the disadvantages described, comprising an open cover which is around the spindles area of the winding machine which is simply connected to a suction fan for removing the heated air which forms by the movement of the spindles in the spindle area. The heated air is then conveyed outside of the working environment partly avoiding the increase in temperature of the room which houses the winding machine.

Nevertheless an apparatus made in this way has disadvantages both in achieving cooling and soundproofing of the working environment and in the production of a covered yarn of higher quality.

With such apparatus, in fact, the risk of contamination of the yarn by external particles is not eliminated. The air which comes into contact with the spindles and the covering yarn is in fact air which is taken directly from the working environment without being filtered and is therefore polluted and dirty air which may, in addition to dirtying the yarn, deposit dust inside the covered yarn winder. This deposited dust in the long term causes a loss of quality of the product manufactured with such yarn.

Moreover the extraction of the air from inside the cover by means of a suction fan, whose rotation speeds are not regulated according to the type of yarn being processed, generates inside the cover an often excessive flow of air which, due to aerodynamic friction, stresses the yarn, causing a considerable number of breakages of threads. Finally a yarn is produced whose quality is jeopardised by the excessive number of knots required for restoring continuity thereto.

The cover used in this apparatus has moreover the disadvantage of only containing the spindles of the winding machine and of not being also around the spindle drive transmission. Neither does it have layers of covering material with specific sound-absorbing properties; the noise level in the area cannot therefore be reduced satisfactorily.

Furthermore the cooling achieved in the working area of the spindles is also insufficient, due both to the fact that the spindle drive transmission is outside the cover and not therefore cooled, and due to the fact that the air used is taken from the environment at the temperature thereof and cooling is achieved by the simple passage of the air to the interior of the cover, in this way obtaining only low cooling efficiencies. This insufficient cooling leads to a certain increase in the temperature of the working environment which in any case means that the special and costly air-conditioning systems have to be maintained in it.

The relative humidity of the working area of the spindles, although using the abovementioned apparatus, also depends strictly on the humidity present in the working environment of the winding machine. In this case, due to the considerable influence which this humidity has on the elastic and resistance features of the yarns, a lower working speed of the winding machine has to be maintained in such circumstances in order to avoid, as far as possible, breakage of the yarns themselves. Said lower speed disadvantageously leads to a lower production rate of the winding machine.

Finally the cover does not have openings for easily inspecting the area of the spindles, thus making the work of the staff assigned to this area extremely difficult.

SUMMARY AND OBJECTS OF THE INVENTION

The object of the present invention is therefore that of providing an insulating air-conditioning and soundproofing apparatus for winding machines in particular and textile machines in general, whereby the following is achieved:

- a low level of noise in the working environment;
- stability in the temperature of the, working environment;
- the control of the relative humidity of the air present in a working area of the machine; and
- the filtering of the air fed into a working area of the machine.

A further object of the present invention is that of providing an apparatus which achieves the above objects and moreover provides the possibility of inspecting air-conditioned and soundproofed areas by the operators assigned.

Another object of the, present invention is that of avoiding the use of air-conditioning systems for the industrial environments wherein these machines operate.

A further object again of the present invention is that of providing an insulating air-conditioning and soundproofing apparatus which can be mounted easily on any type of winding machine, be it of new or previous manufacture.

The abovementioned objects are achieved with an air-conditioning and soundproofing apparatus.

The combination of a closed tubular cover, having hatches and soundproofing and thermally insulating material, with air-conditioning means, which feed air into the tubular cover after having filtered and brought the air to a predetermined and desired values of temperature and relative humidity, and with the manifold means, for discharging the conditioned air from the tubular cover directly to the outside of the environment of the machine, allows the present invention to achieve the objects of separating a work area of the textile machine from the working environment of the same machine, preventing dust from reaching the worked yarn and reducing the noise level and the temperature in said working environment, allowing at the same time an inspection of the work area by the personnel.

Furthermore by the present invention, it is possible to put the worked yarn into contact with an air which has the correct temperature and relative humidity required by the kind of yarn being worked.

BRIEF DESCRIPTION OF THE DRAWINGS

Other advantages and features of the present invention will be understood on reading the description which follows with reference to the accompanying drawings in which.

DETAILED DESCRIPTION OF THE PREFERRED EMBODIMENT

Figure 1:
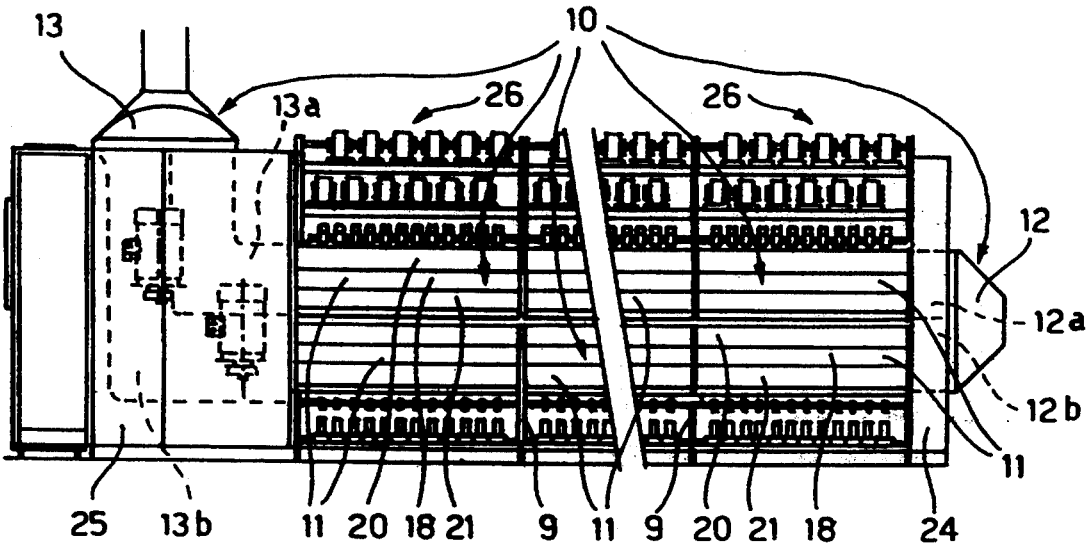
FIG. 1 is a front view of a winding machine on which the apparatus of the present invention is mounted.

FIG. 1 shows the air-conditioning and soundproofing apparatus 10 according to the present invention; it comprises an insulation cover 11 for four, single working areas of the spindles arranged in four rows with two on each of the frames 9 of the winding machine; an air-conditioning device 12 which takes atmospheric air from the working environment of the winding machine and, after having brought it to a predetermined condition, feeds it, by inlet ducts, into the insulation cover 11; and a discharge manifold 13 which collects, by outlet ducts, the air used for cooling the working areas of the spindles and conveys it outside of the working environment of the winding machine.

Figure 2:
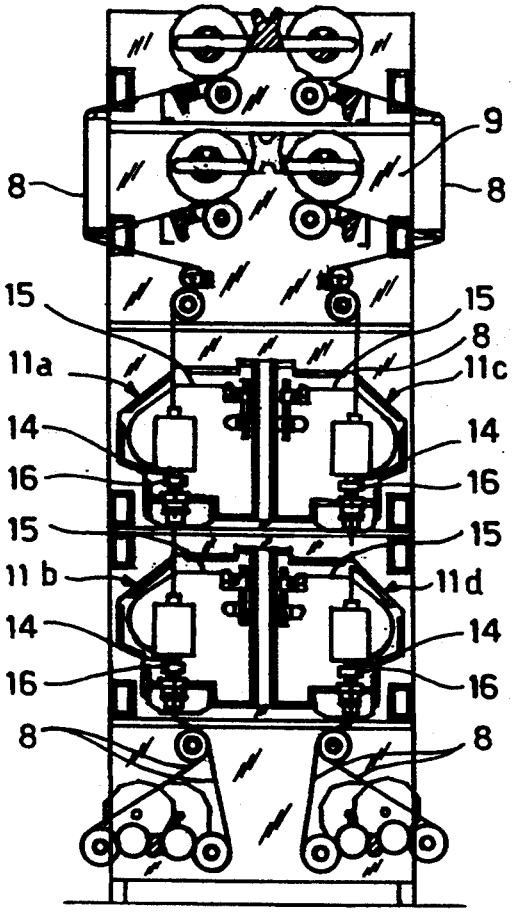
FIG. 2 is a section view of a compartment, of the winding machine on which the apparatus of the present invention is mounted.

FIG. 1 shows only the inlet ducts 12*a* and 12*b* and the outlet ducts 13*a* and 13*b* corresponding to the cells or tubular portions 11*a* and 11*b* shown in FIG. 2; the inlet ducts and outlet ducts of the cells 11*c* and 11*d* are similar to the above mentioned inlet and outlet ducts but they are not shown in the figures.

As shown in FIG. 2, the insulation cover 11 is fixed to the frame 9 of the winding machine; and, as a whole, is tubular in shape. The insulation cover 11 provides for the complete winding of the spindles 14 shown in FIG. 2 and of the whole working area adjacent thereto, destined specifically for covering the yarn. More particularly the insulation cover also contains the yarn guide 15 and the transmission assembly 16 for driving the spindles 14.

The incorporation of the guides 15 for the yarn 8 inside the insulation cover is extremely advantageous since the yarn guide 15 is set up with a detector (not shown) to send an electronic pulse to an indicator, be it optical or acoustic, should there be no yarn, the latter having been broken or used up. The transducers required for detecting the lack of yarn in the yarn guides are often highly sensitive to changes in temperature, humidity and pressure, and maintaining them in an environment with relative humidity, temperature and pressure which are constant or whose variations are controlled, as occurs inside said cover, enables the otherwise possible malfunctioning of these transducers to be avoided.

The same FIG. 2 shows moreover that the insulation cover is divided into cells 11*c*, 11*d* or tubular portions 11*a*, 11*b* which insulate one between the other the various rows of spindles 14; in this way improved soundproofing and the possibility of working on the spindles of a single row without disturbing or being disturbed by the work of other rows of spindles are advantageously achieved, as well as the creation of a greater obstacle to the vorticose flows of air which, inside the insulation cover, damage the yarn and interfere with the covering operation. It is nevertheless understood that a tubular section of any shape and not divided into cells can also be foreseen for the present invention.

Figure 3:
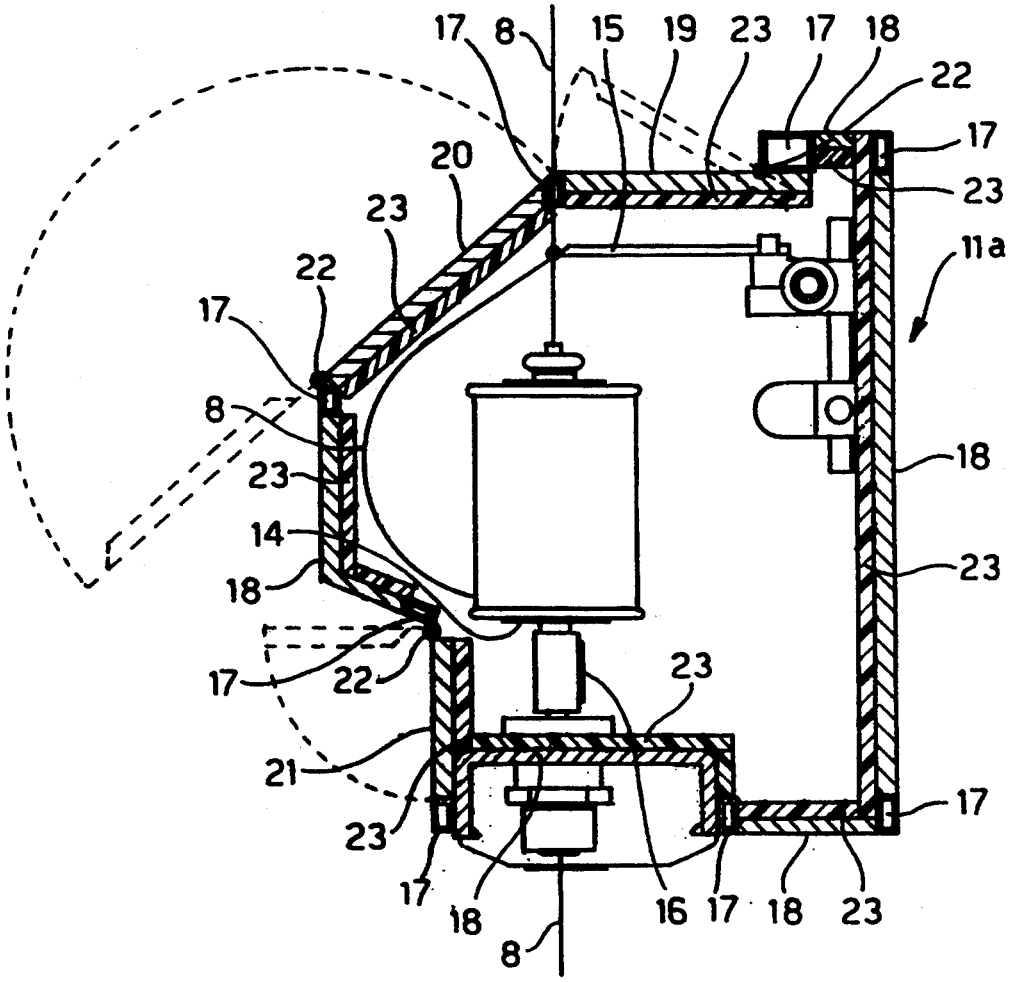
FIG. 3 is a section view of a detail of the cover forming part of the apparatus of the present invention.

The insulation cover 11 is fastened to the frame 9 of the winding machine shown in FIG. 1 in any appropriate manner, for example by means of rivets or weldings; as shown in FIG. 3, it comprises metal bars 17 which support fixed metal plates 18 and movable metal plates 19, 20 and 21.

The plates 18 can also be attached to metal bars by means of rivets or weldings, while the preferred mobile plates 19, 20 and 21 are fastened by means of pins 22 to said bars along one side, the opposite side to the one hinged, being connected to the metal bars 17 by release closure means (not shown).

The mobile plates 19, 20 and 21 define respectively an upper hatch which enables reknotting of the broken threads, an intermediate hatch which enables the bobbins which hold the covering yarn to be removed and repositioned on the spindles, and a lower hatch which enables the tangential belt which moves the spindles to be adjusted, or the spindles to be replaced.

Through these hatches the personnel can therefore, without any hindrance, reach any point of the working area of the spindles enclosed inside the insulation cover.

Moreover, with the winding machine in working condition, when the hatches can remain fully closed, the insulation cover totally insulates the working area of the spindles, preventing dusty material from entering and maintaining internally a constant and optimum flow of cooling air.

According to the present invention, manufacture of the insulation cover from nonmetallic materials, for example plastic material which has itself soundproofing and thermally insulating features, or by means of elements having different shapes and structures from those of the bars and plates shown, can obviously be foreseen.

As is known, in general the winding machine shown in FIG. 1 is divided into longitudinal modules or compartments 26; according to the invention the hatches extend longitudinally along the whole length of the compartment, being preferably hinged along one of the longer sides. They can therefore be opened easily by being made to rotate around this hinged side. The closure of the hatches can be ensured by means of the aforementioned release closure means and sealed by elastic sealing elements attached along the external edges of the hatches themselves.

According to the present invention, a considerable lowering of the sound emissions and heat dispersions from the working area of the spindles are achieved by providing a panel 23 shown in FIG. 3 and formed of one or more layers of soundproofing and thermally insulating material internally adhering to the plates of the insulation cover, glass wool material is for example suitable for the purpose.

However, this object is sufficiently achieved providing the panels 23 only on the outer plates which are arranged towards the outer part of the textile machine, that is to say the part of the tubular cover which is arranged towards the working environment of the textile machine.

The air-conditioning device 12 shown only in FIG. 1 is placed near the first drive assembly 24 of the winding machine to filter, cool and humidify the atmospheric air which is fed into the cover, bringing it to predetermined conditions of temperature and relative humidity considered most suitable for the type of yarn being processed.

The air-conditioning device 12 moreover feeds by means of the inlet ducts housed inside the first drive assembly 24, the air into the cover in such a way to guarantee, with reference to the length of the path to be covered inside the winding machine, and with reference to the load losses which occur along the path itself, the speed which is to be conferred to the flow of air for allowing the air emission from the discharge manifold arranged at the opposite end to the first drive assembly 24.

The possibility of controlling the speed of the flow of air inside the cover also allows the hydrodynamic friction between the air and the yarn being processed to be restricted as required. The yarn therefore, being stressed mechanically to a minimal extent, undergoes a smaller number of breakages and thus has a smaller number of joining knots and is consequently of higher quality.

The discharge manifold 13 is positioned in the proximity of the second drive assembly 25 of the winding machine at the opposite end to the first drive assembly 24; it collects, by means of the outlet ducts housed inside the drive assembly 25, the "exhausted" cooling air and conveys it outside of the working area or if necessary towards further users to recover the heat contained therein.

By means of the present apparatus is possible to obtain, for example, a noise level of 500 decibel A in the working department housing the textile machine and a temperature of 22°–25° C. with 60–70% of the relative humidity in the work area of the textile machine.

The insulating air conditioning and soundproofing apparatus of the present invention can be coupled to the frame of any textile machine of new or previous manufacture, without requiring for this mounting neither the design of a new structural configuration of a textile machine, nor special adaptations or couplings for textile machines of previous manufacture.

What is claimed is:

1. An apparatus for a textile machine placed in a room of a mill and having a horizontally elongated frame supporting longitudinal rows of yarn-working devices, said apparatus comprising:

a horizontally elongated, tubular insulation cover fixed to the frame and enclosing in its interior the rows of yarn-working devices, said tubular insulation cover being provided with hatches for inspecting the yarn-working devices and at least an inner part of said tubular insulation cover being provided with soundproofing and thermally insulating material;

means for conditioning atmospheric air, said conditioning means being situated at one end of the textile machine and also being in communication with one longitudinal end of the tubular insulation cover, said conditioning means further taking air from the room in which the textile machine is placed and, after having filtered the air and having brought said air to predetermined values of selected temperature and relative humidity, feeding conditioned air into the tubular insulation cover; and manifold means, situated at an opposite longitudinal end of the one end occupied by said conditioning means, for discharging said conditioned air from the tubular insulation cover to an exterior outside of the room in which the textile machine is placed.

2. An apparatus according to claim 1, characterised in that said hatches extend longitudinally for an entire length of each of the longitudinal rows of the yarn-working devices.

3. An apparatus according to claim 1, characterised in that said soundproofing and thermally insulating material is a panel of at least one layer attached internally to the tubular insulation cover.

4. An apparatus according to claim 1, characterised in that said tubular insulation cover is divided into cells, each having a generally polygonal cross section.

5. An apparatus according to claim 1, characterised in that said conditioning means are situated in proximity to a first drive assembly which is located at the one longitudinal end of the tubular insulation cover.

6. An apparatus according to claim 5, characterised in that the manifold means are situated in proximity to a second drive assembly which is located at the opposite longitudinal end of the one end occupied by said conditioning means.

* * * * *